US009441572B2

(12) United States Patent
Dölker

(10) Patent No.: US 9,441,572 B2
(45) Date of Patent: Sep. 13, 2016

(54) METHOD FOR CONTROLLING AND REGULATING THE FUEL PRESSURE IN THE COMMON RAIL OF AN INTERNAL COMBUSTION ENGINE

(75) Inventor: Armin Dölker, Friedrichshafen (DE)

(73) Assignee: MTU FRIEDRICHSHAFEN GMBH, Friedrichshafen (DE)

( * ) Notice: Subject to any disclaimer, the term of this patent is extended or adjusted under 35 U.S.C. 154(b) by 516 days.

(21) Appl. No.: 13/382,123

(22) PCT Filed: Jun. 17, 2010

(86) PCT No.: PCT/EP2010/003652

§ 371 (c)(1),
(2), (4) Date: Jan. 3, 2012

(87) PCT Pub. No.: WO2011/000478

PCT Pub. Date: Jan. 6, 2011

(65) Prior Publication Data

US 2012/0097134 A1 Apr. 26, 2012

(30) Foreign Application Priority Data

Jul. 2, 2009 (DE) ..... 10 2009 031 527

(51) Int. Cl.
*F02D 41/38* (2006.01)
*F02D 41/14* (2006.01)
(Continued)

(52) U.S. Cl.
CPC ..... *F02D 41/3863* (2013.01); *F02D 41/3845* (2013.01); *F02D 2041/1432* (2013.01); *F02D 2041/2027* (2013.01); *F02D 2250/31* (2013.01); *F02M 63/025* (2013.01)

(58) Field of Classification Search
CPC ..... F02D 41/3845; F02D 41/3809; F02D 41/3827; F02D 41/3836; F02D 41/3854; F02D 41/3863; F02D 41/3872; F02D 41/3082; F02D 2041/2027; F02D 2041/1432; F02D 2250/31; F02M 63/025
USPC ..... 123/446, 447, 514, 456, 457, 458, 511, 123/495, 198 D, 179.16, 339.24, 399, 690, 123/357, 506; 701/113, 102, 103, 104, 105; 239/533.2
See application file for complete search history.

(56) References Cited

U.S. PATENT DOCUMENTS 4,884,545 A * 12/1989 Mathis ..... 123/447
5,727,515 A * 3/1998 Biester ..... 123/198 D
(Continued)

FOREIGN PATENT DOCUMENTS

DE 19731995 1/1999
DE GB 2331597 A * 5/1999 ..... F02D 41/2406
(Continued)

*Primary Examiner* — Stephen K Cronin
*Assistant Examiner* — Brian Kirby
(74) *Attorney, Agent, or Firm* — Lucas & Mercanti, LLP; Klaus P. Stoffel

(57) ABSTRACT

Proposed is a method for controlling and regulating an internal combustion engine (1), in which the rail pressure (pCR) is controlled via a suction throttle (4) on the low pressure side as a first pressure-adjusting element in a rail pressure control loop. The invention is characterized in that a rail pressure disturbance variable (VDRV) is generated in order to influence the rail pressure (pCR) via a pressure control valve (12) on the high pressure side as a second pressure-adjusting element, by means of which fuel is redirected in a controlled manner from the rail (6) into a fuel tank (2), the rail pressure disturbance variable (VDRV) being calculated using a corrected target volume flow (Vk (SL)) of the pressure control valve (12).

8 Claims, 7 Drawing Sheets

(51) Int. Cl.

| | |
|---|---|
| *F02D 41/20* | (2006.01) |
| *F02M 63/02* | (2006.01) |

(56) References Cited

U.S. PATENT DOCUMENTS

| | | | | |
|---|---|---|---|---|
| 5,758,622 | A * | 6/1998 | Rembold et al. | 123/456 |
| 5,878,718 | A * | 3/1999 | Rembold | F02D 33/006 123/198 D |
| 5,941,214 | A * | 8/1999 | Hoffmann et al. | 123/456 |
| 6,016,791 | A * | 1/2000 | Thomas et al. | 123/497 |
| 6,119,655 | A * | 9/2000 | Heinitz | F02D 41/20 123/447 |
| 6,142,120 | A * | 11/2000 | Biester et al. | 123/456 |
| 6,223,725 | B1 * | 5/2001 | Onishi et al. | 123/447 |
| 6,230,688 | B1 * | 5/2001 | Faix et al. | 123/495 |
| 6,234,148 | B1 * | 5/2001 | Hartke et al. | 123/447 |
| 6,311,674 | B1 * | 11/2001 | Igashira et al. | 123/458 |
| 6,378,501 | B1 * | 4/2002 | Hisato et al. | 123/458 |
| 6,609,500 | B2 * | 8/2003 | Ricco et al. | 123/446 |
| 6,823,847 | B2 * | 11/2004 | Carlo | 123/458 |
| 6,840,228 | B2 * | 1/2005 | Yomogida | F02D 41/3836 123/447 |
| 6,912,983 | B2 * | 7/2005 | Okamoto | F02D 41/062 123/179.1 |
| 7,017,549 | B2 * | 3/2006 | Doelker | 123/399 |
| 7,025,050 | B2 * | 4/2006 | Oono et al. | 123/690 |
| 7,040,291 | B2 * | 5/2006 | Veit | 123/458 |
| 7,059,302 | B2 | 6/2006 | Lemoure | |
| 7,171,944 | B1 * | 2/2007 | Oono | F02M 37/04 123/357 |
| 7,240,667 | B2 * | 7/2007 | Dolker | 123/456 |
| 7,243,636 | B2 * | 7/2007 | Joos | F02D 41/3836 123/446 |
| 7,270,115 | B2 * | 9/2007 | Dolker | F02D 41/3845 123/447 |
| 7,284,539 | B1 * | 10/2007 | Fukasawa | 123/506 |
| 7,318,414 | B2 * | 1/2008 | Hou | 123/458 |
| 7,347,188 | B2 * | 3/2008 | Ohshima | 123/458 |
| 7,451,038 | B2 * | 11/2008 | Kosiedowski et al. | 701/103 |
| 7,606,656 | B2 * | 10/2009 | Dolker | 701/113 |
| 7,779,816 | B2 * | 8/2010 | Dolker | 123/456 |
| 7,806,104 | B2 * | 10/2010 | Sadakane et al. | 123/339.24 |
| 8,210,156 | B2 * | 7/2012 | Kokotovic et al. | 123/458 |
| 2004/0016830 | A1 * | 1/2004 | Boos et al. | 239/533.2 |
| 2006/0225707 | A1 * | 10/2006 | Eser | F02D 41/3836 123/458 |
| 2008/0257314 | A1 * | 10/2008 | Veit | F02D 41/1401 123/511 |
| 2009/0164102 | A1 * | 6/2009 | Olbrich et al. | 701/103 |
| 2009/0326788 | A1 * | 12/2009 | Yuasa | F02D 41/3809 701/104 |
| 2010/0269794 | A1 * | 10/2010 | Li | F02D 41/3845 123/495 |
| 2012/0097134 | A1 * | 4/2012 | Dolker | 123/511 |
| 2012/0166063 | A1 * | 6/2012 | Dolker | F02D 41/1401 701/102 |

FOREIGN PATENT DOCUMENTS

| | | | | | |
|---|---|---|---|---|---|
| DE | 19802583 | Y | | 8/1999 | |
| DE | 10261414 | | | 7/2004 | |
| DE | 10261446 | A | | 7/2004 | |
| DE | 10261446 | A1 | * | 7/2004 | F02D 41/123 |
| DE | 10330466 | | | 10/2004 | |
| DE | 102004061474 | | | 6/2006 | |
| DE | WO/2006/1061288 | | * | 6/2006 | |
| DE | 102005029138 | A | | 12/2006 | |
| DE | 102006018164 | Y | | 8/2007 | |
| DE | 102008040441 | | | 2/2008 | |
| DE | 102007059352 | | | 6/2009 | |
| GB | 2331597 | A | * | 5/1999 | F02D 41/38 |
| JP | 2008215201 | A | * | 9/2008 | F02D 41/3845 |
| JP | 2008215201 | A | * | 9/2008 | F02D 41/2464 |
| WO | 2004036034 | Y | | 11/2005 | |

* cited by examiner

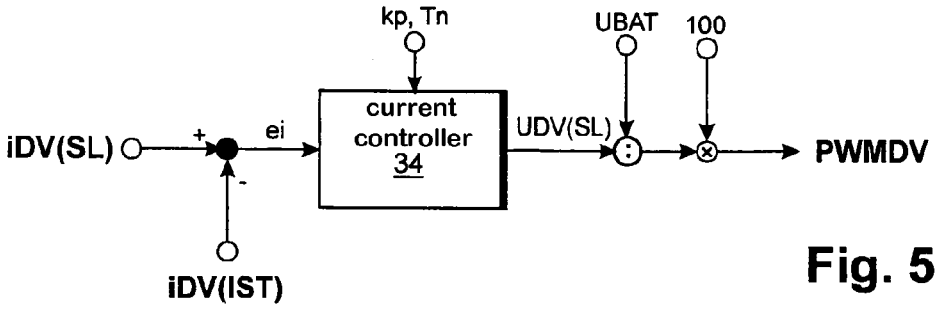
Fig. 5
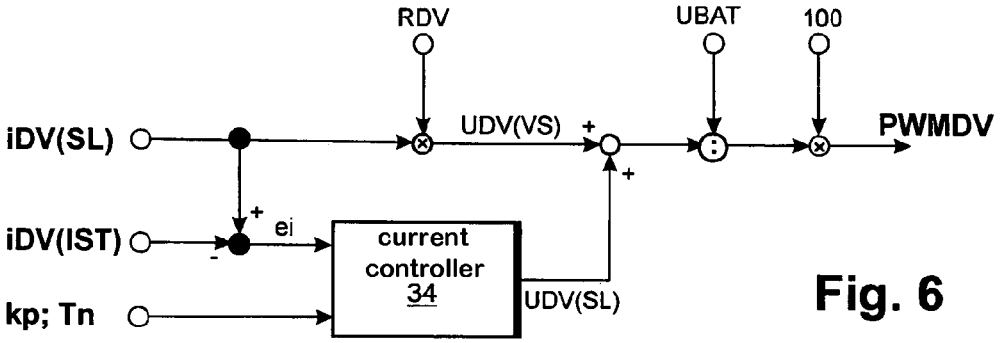
Fig. 6
22
| QSL [mm³/stroke] ↑ \ nMOT [1/min] → | 0 | ... | 1000 | ... | 2000 |
|---|---|---|---|---|---|
| 270 | 0 | ... | 0 | ... | 0 |
| 240 | 0 | ... | 0 | ... | 0 |
| . | . | | . | | . |
| 120 | 0 | ... | 0 | ... | 0 |
| 90 | 0.5 | ... | 0.5 | ... | 0.5 |
| 60 | 1 | ... | 1 | ... | 1 |
| 30 | 1.5 | ... | 1.5 | ... | 1.5 |
| 0 | 2 | ... | 2 | ... | 2 |
Fig. 7

METHOD FOR CONTROLLING AND REGULATING THE FUEL PRESSURE IN THE COMMON RAIL OF AN INTERNAL COMBUSTION ENGINE

The present application is a 371 of International application PCT/EP2010/003652, filed Jun. 17, 2010, which claims priority of DE 10 2009 031 527.6, filed Jul. 2, 2009, the priority of these applications is hereby claimed and these applications are incorporated herein by reference.

BACKGROUND OF THE INVENTION

The invention concerns a method for the open-loop and closed-loop control of an internal combustion engine.

In an internal combustion engine with a common rail system, the quality of combustion is critically determined by the pressure level in the rail. Therefore, in order to stay within legally prescribed emission limits, the rail pressure is automatically controlled. A closed-loop rail pressure control system typically comprises a comparison point for determining a control deviation, a pressure controller for computing a control signal, the controlled system, and a software filter for computing the actual rail pressure in the feedback path. The control deviation is computed as the difference between a set rail pressure and an actual rail pressure. The controlled system comprises the pressure regulator, the rail, and the injectors for injecting the fuel into the combustion chambers of the internal combustion engine.

DE 197 31 995 A1 discloses a common rail system with closed-loop pressure control, in which the pressure controller is equipped with various controller parameters. The various controller parameters are intended to make the automatic pressure control more stable. The pressure controller then uses the controller parameters to compute the control signal for a pressure control valve, by which the fuel drain-off from the rail into the fuel tank is set. Consequently, the pressure control valve is arranged on the high-pressure side of the common rail system. This source also discloses an electric pre-feed pump or a controllable high-pressure pump as alternative measures for automatic pressure control.

DE 103 30 466 B3 also describes a common rail system with closed-loop pressure control, in which, however, the pressure controller acts on a suction throttle by means of a control signal. The suction throttle in turn sets the admission cross section to the high-pressure pump. Consequently, the suction throttle is arranged on the low-pressure side of the common rail system. This common rail system can be supplemented by a passive pressure control valve as a protective measure against an excessively high rail pressure. The fuel is then redirected from the rail into the fuel tank via the opened pressure control valve. A similar common rail system with a passive pressure control valve is known from DE 10 2006 040 441 B3.

Control leakage and constant leakage occurs in a common rail system as a result of design factors. Control leakage occurs when the injector is being electrically activated, i.e., for the duration of the injection. Therefore, the control leakage decreases with decreasing injection time. Constant leakage is always present, i.e., even when the injector is not activated. This is also caused by part tolerances. Since the constant leakage increases with increasing rail pressure and decreases with falling rail pressure, the pressure fluctuations in the rail are damped. In the case of control leakage, on the other hand, the opposite behavior is seen. If the rail pressure rises, the injection time is shortened to produce a constant injection quantity, which leads to decreasing control leakage. If the rail pressure drops, the injection time is correspondingly increased, which leads to increasing control leakage. Consequently, control leakage leads to intensification of the pressure fluctuations in the rail. Control leakage and constant leakage represent a loss volume flow, which is pumped and compressed by the high-pressure pump.

However, this loss volume flow means that the high-pressure pump must be designed larger than necessary. In addition, some of the motive energy of the high-pressure pump is converted to heat, which in turn causes heating of the fuel and reduced efficiency of the internal combustion energy.

In present practice, to reduce the constant leakage, the parts are cast together. However, a reduction of the constant leakage has the disadvantages that the stability behavior of the common rail system deteriorates and that automatic pressure control becomes more difficult. This becomes clear in the low-load range, because here the injection quantity, i.e., the removed fuel volume, is very small. This also becomes clear in a load reduction from 100% to 0%, since here the injection quantity is reduced to zero, and therefore the rail pressure is only slowly reduced again. This in turn results in a long correction time.

SUMMARY OF THE INVENTION

This objective is achieved by a method for the open-loop and closed-loop control of an internal combustion engine with the features of claim 1. Refinements are described in the dependent claims.

The method consists not only in providing closed-loop rail pressure control by means of the suction throttle on the low-pressure side as the first pressure regulator, but also in generating a rail pressure disturbance variable for influencing the rail pressure by means of a pressure control valve on the high-pressure side as a second pressure regulator. Fuel is redirected from the rail into a fuel tank by the pressure control valve on the high-pressure side. An essential element of the invention is that a constant leakage is reproduced by the control of the pressure control valve. The rail disturbance variable is computed on the basis of a corrected set volume flow of the pressure control valve, which in turn is computed from a static set volume flow and a dynamic set volume flow.

The static set volume flow is computed as a function of a set injection quantity, alternatively, a set torque, and an engine speed by means of a set volume flow input-output map. The set volume flow input-output map is realized in such a form that in a low-load range a set volume flow with a positive value, for example, 2 liters/minute, is computed and in a normal operating range a set volume flow of zero is computed. In accordance with the invention, the low-load range is understood to mean the range of small injection quantities and thus low engine output.

The dynamic set volume flow of the pressure control valve is computed by a dynamic correction unit as a function of the set rail pressure and the actual rail pressure by computing a resultant control deviation and setting the dynamic set volume flow to a value of zero when the resulting control deviation is less than zero. If, on the other hand, the resulting control deviation is greater than or equal to zero, then the dynamic set volume flow is set to the value of the product of the resulting control deviation and a factor. In other words, the dynamic set volume flow is determined to a great extent by the control deviation of the rail pressure. If the control deviation is negative and falls below a limit, i.e., for example, in the case of a load reduction, the static set volume flow is corrected by means of the dynamic set volume flow. Otherwise, no change is made in the static set volume flow.

Since during steady operation the fuel is redirected from the rail only in the low-load range and in small quantities, there is no significant increase in the fuel temperature and also no significant reduction of the efficiency of the internal combustion engine. The increased stability of the closed-loop rail pressure control system in the low-load range can be recognized from the fact that the rail pressure in the coasting range remains more or less constant, and in a load reduction the rail pressure peak value is clearly lower. The pressure increase of the rail pressure is counteracted by means of the dynamic set volume flow, with the advantage that the correction time of the system can be improved once again.

The drawings illustrate a preferred embodiment of the invention.

BRIEF DESCRIPTION OF THE DRAWING

FIG. 5 is a closed-loop current control system.

FIG. 6 is a closed-loop current control system with input control.

FIG. 7 is a set volume flow input-output map.

DETAILED DESCRIPTION OF THE INVENTION

Figure 1:
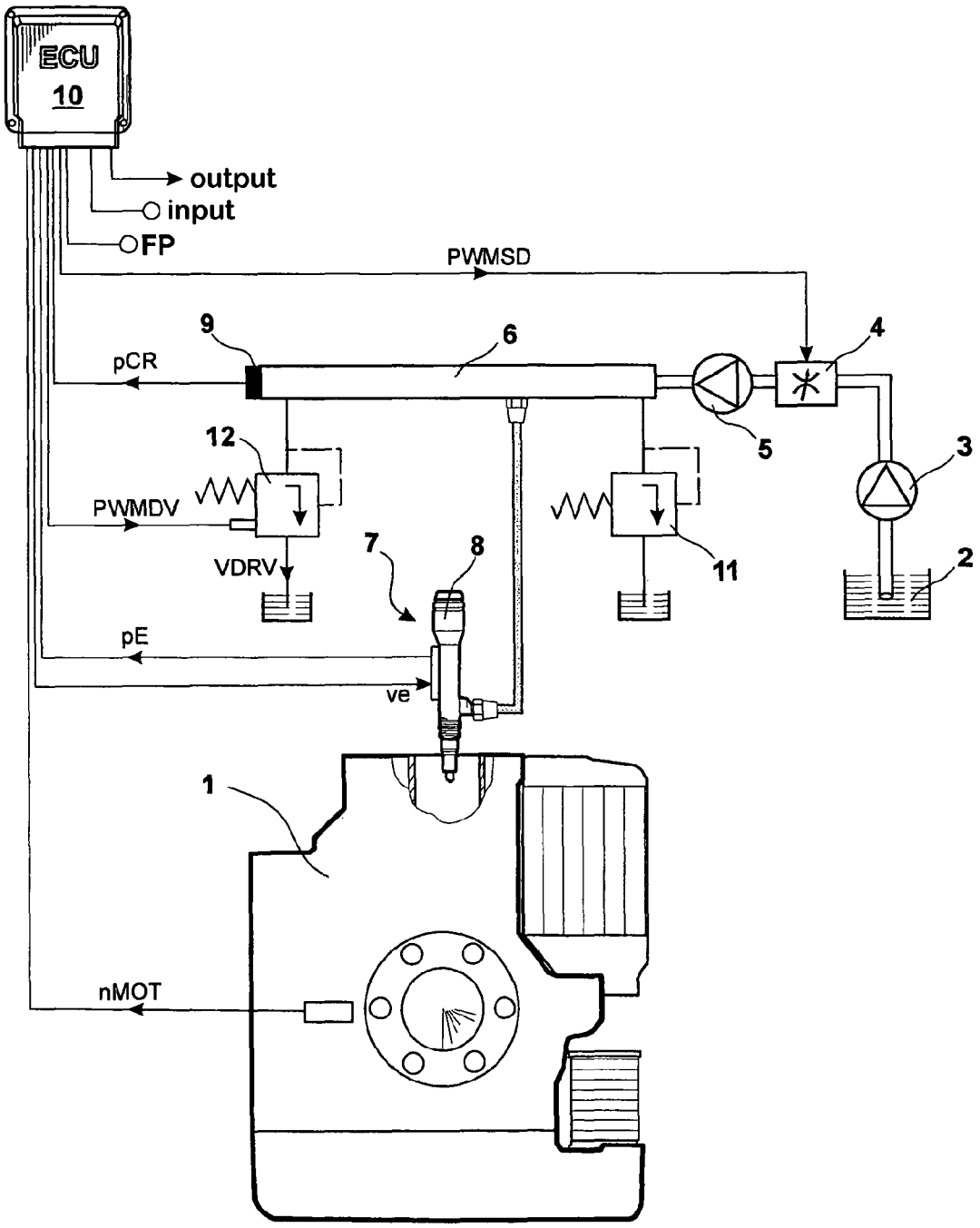
FIG. 1 is a system diagram.

FIG. 1 shows a system diagram of an electronically controlled internal combustion engine 1 with a common rail system.

The common rail system comprises the following mechanical components: a low-pressure pump 3 for pumping fuel from a fuel tank 2, a variable suction throttle 4 on the low-pressure side for controlling the fuel volume flow flowing through the lines, a high-pressure pump 5 for pumping the fuel at increased pressure, a rail 6 for storing the fuel, and injectors 7 for injecting the fuel into the combustion chambers of the internal combustion engine 1. The common rail system can also be realized with individual accumulators, in which case an individual accumulator 8 is integrated, for example, in the injector 7 as an additional buffer volume. To protect against an impermissibly high pressure level in the rail 6, a passive pressure control valve 11 is provided, which, in its open state, redirects the fuel from the rail 6. An electrically controllable pressure control valve 12 also connects the rail 6 with the fuel tank 2. A fuel volume flow redirected from the rail 6 into the fuel tank 2 is defined by the position of the pressure control valve 12. In the remainder of the text, this fuel volume flow is denoted. the rail pressure disturbance variable VDRV.

The operating mode of the internal combustion engine 1 is determined by an electronic control unit (ECU) 10. The electronic control unit 10 contains the usual components of a microcomputer system, for example, a microprocessor, interface adapters, buffers, and memory components (EEPROM, RAM). Operating characteristics that are relevant to the operation of the internal combustion engine 1 are applied in the memory components in the form of input-output maps/characteristic curves. The electronic control unit 10 uses these to compute the output variables from the input variables. FIG. 1 shows the following input variables as examples: the rail pressure pCR, which is measured by means of a rail pressure sensor 9, an engine speed nMOT, a signal FP, which represents an engine power output desired by the operator, and an input variable INPUT, which represents additional sensor signals, for example, the charge air pressure of an exhaust gas turbocharger. In a common rail system with individual accumulators 8, the individual accumulator pressure pE is an additional input variable of the electronic control unit 10.

FIG. 1 also shows the following as output variables of the electronic control unit 10: a signal PWMSD for controlling the suction throttle 4 as the first pressure regulator, a signal ve for controlling the injectors 7 (injection start/injection end), a signal PWMDV for controlling the pressure control valve 12 as the second pressure regulator, and an output variable OUTPUT. The signal PWMDV defines the position of the pressure control valve 12 and thus the rail pressure disturbance variable VDRV. The output variable OUTPUT is representative of additional control signals for the open-loop and closed-loop control of the internal combustion engine 1, for example, a control signal for activating a second exhaust gas turbocharger during a register supercharging.

Figure 2:
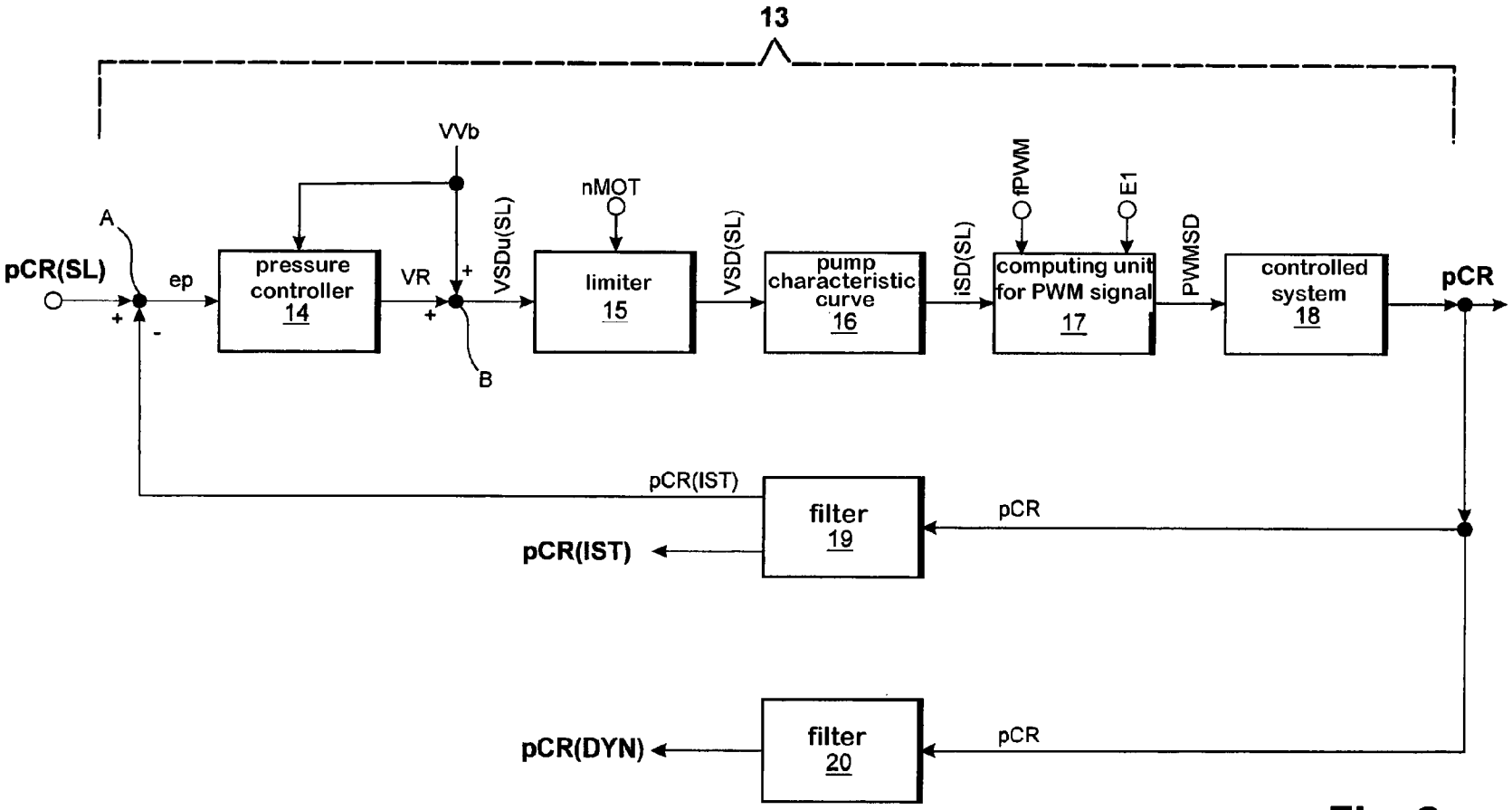
FIG. 2 is a closed-loop rail pressure control system.

FIG. 2 shows a closed-loop rail pressure control system 13 for automatically controlling the rail pressure pCR. The input variables of the closed-loop rail pressure control system 13 are: a set rail pressure pCR(SL), a volume flow that characterizes the set consumption VVb, the engine speed nMOT, the PWM base frequency fPWM, and a variable E1. The variable E1 combines, for example, the battery voltage and the ohmic resistance of the suction throttle coil with lead-in wire, which enter into the computation of the PWM signal. The output variables of the closed-loop rail pressure control system 13 are the raw value of the rail pressure pCR, an actual rail pressure pCR(IST), and a dynamic rail pressure pCR(DYN). The actual rail pressure pCR(IST) and the dynamic rail pressure pCR (DYN) are further processed in the open-loop control system shown in FIG. 3.

Figure 3:
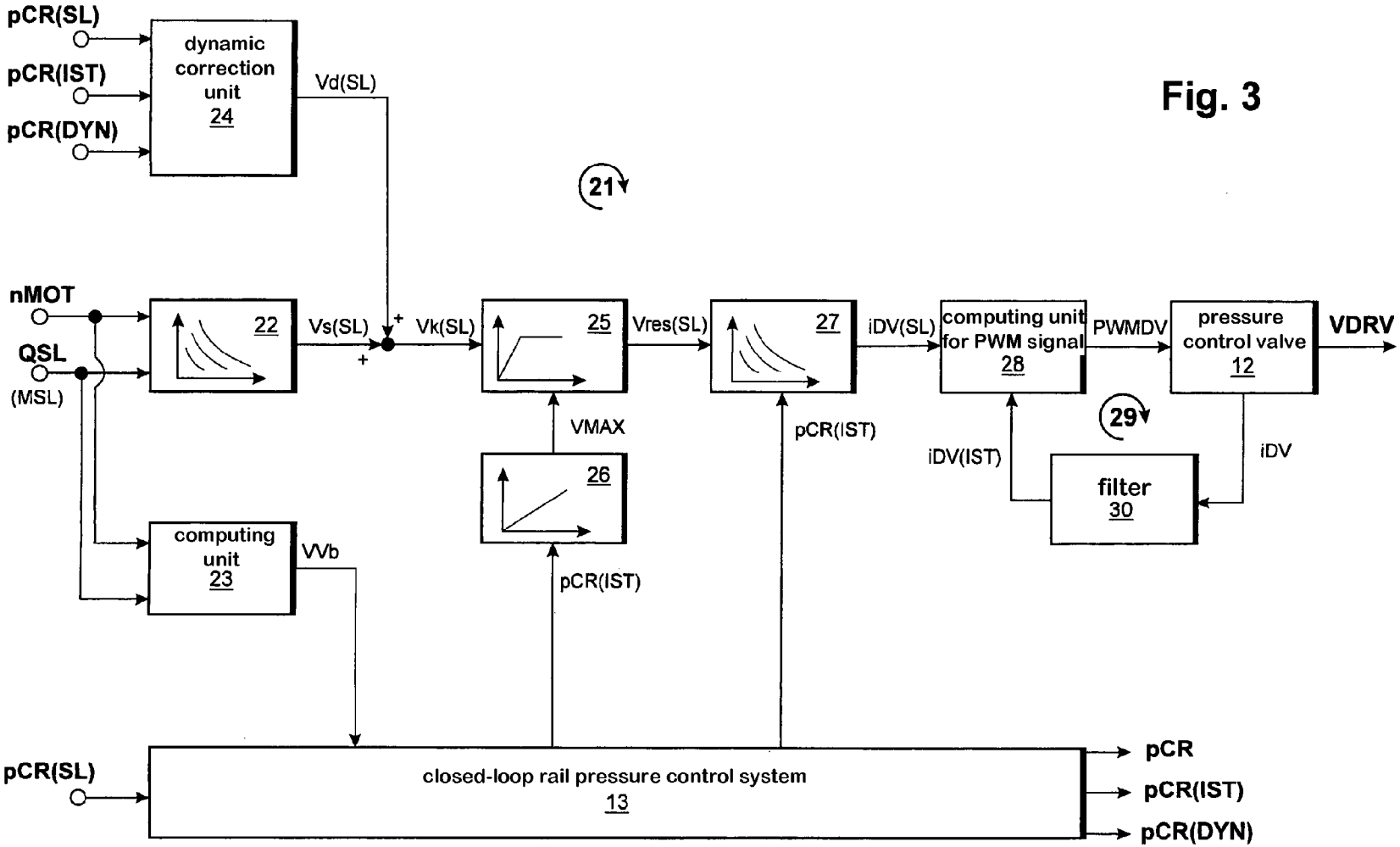
FIG. 3 is a block diagram of the closed-loop rail pressure control system with an open-loop control unit.

The actual rail pressure pCR(IST) is computed from the raw value of the rail pressure pCR by means of a first filter 19. This value, is then compared with the set value pCR(SL) at a summation point A, and a control deviation ep is obtained from this comparison. A correcting variable. is computed from the control deviation ep by means of a pressure controller 14. The correcting variable represents a volume flow VR with the physical unit of liters/minute. The computed set consumption VVb is added to the volume flow VR at a summation point B. The set consumption VVb is computed by a computing unit 23, which is shown in FIG. 3 and will be explained in connection with the description of FIG. 3. The result of the addition at summation point B represents an unlimited set volume flow VSDu(SL). The unlimited set volume flow VSDu(SL) is then limited by a limiter 15 as a function of the engine speed nMOT. The output variable of the limiter 15 is a set volume flow VSD(SL) of the suction throttle. A set electric current iSD(SL) of the suction throttle is then assigned to the set volume flow VSD(SL) by the pump characteristic curve 16. The set current iSD(SL) is converted to a PWM signal PWMSD in a computing unit 17. The PWM signal PWMSD represents the duty cycle, and the frequency fPWM corresponds to the base frequency. The magnetic coil of the suction throttle is then acted upon by the PWM signal PWMSD. This changes the displacement of the magnetic core, and the output of the high-pressure pump is freely controlled in this way. For safety reasons, the suction throttle is open in the absence of current and is acted upon by current via PWM activation to move in the direction of the closed position. A closed-loop current control system can be subordinate to the PWM signal computing unit 17, as described in DE 10 2004 061 474 A1. The high-pressure pump, the suction throttle, the rail, and possibly the individual accumulators represent a controlled system 18. The closed-loop control system is thus closed. A dynamic rail pressure pCR(DYN) is computed from the raw value of the rail pressure pCR by means of a second filter 20. The dynamic rail pressure pCR(DYN) is one of the input variables of the block diagram of FIG. 3. In this regard, the second filter 20 has a smaller time constant and smaller phase distortion than the first filter 19 in the feedback path.

FIG. 3 in the form of a block diagram shows the greatly simplified closed-loop rail pressure control system 13 and an open-loop control unit 21. The open-loop control system 21 generates the rail pressure disturbance variable VDRV, i.e., that volume flow which the pressure control valve redirects into the fuel tank from the rail. The input variables of the open-loop control unit 21 are: the set rail pressure pCR(SL), the actual rail pressure pCR(IST), the dynamic rail pressure pCR(DYN), the engine speed nMOT, and the set injection quantity QSL. The set injection quantity QSL is either computed by an input-output map as a function of the power desired by the operator or represents the correcting variable of a speed controller. The physical unit of the set injection quantity is $mm^3$/stroke. In a torque-based structure, a set torque MSL is used instead of the set injection quantity QSL. The output variable of the open-loop control system 21 is the rail pressure disturbance variable VDRV.

Figure 4:
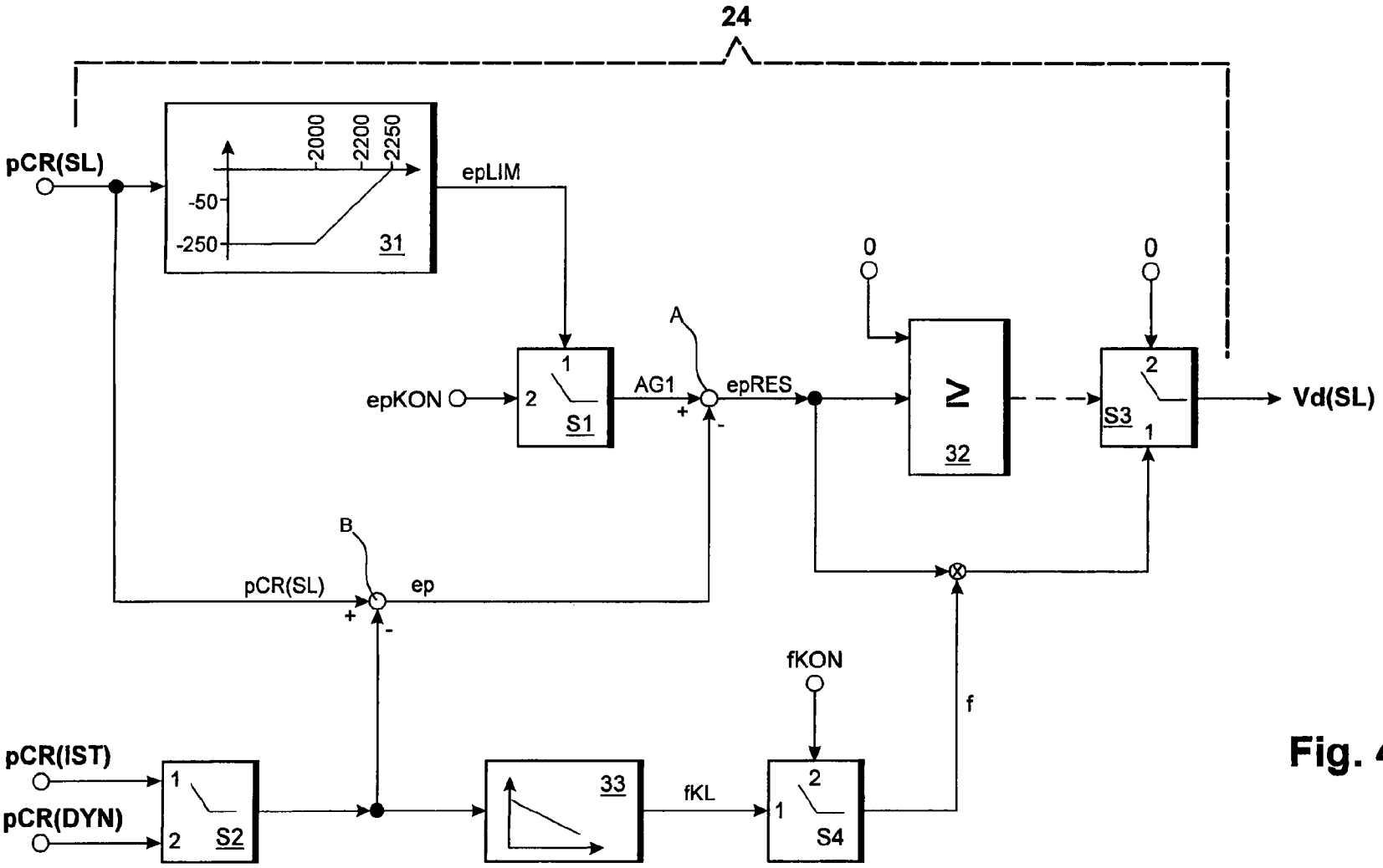
FIG. 4 is a block diagram of the dynamic correction unit.

The static set volume flow Vs(SL) for the pressure control valve is computed from the engine speed nMOT and the set injection quantity QSL by a set volume flow input-output map 22 (3D input-output map). The set volume flow input-output map 22 is realized in such a form that in the low-load range, for example, at idle, a positive value of the static set volume flow Vs(SL) is computed, while in the normal operating range a static set volume flow Vs(SL) of zero is computed. A possible embodiment of the set volume flow input-output map 22 is shown in FIG. 7 and will be explained in detail in the description of FIG. 7. A computing unit 23 also uses the engine speed nMOT and the set injection quantity QSL to compute the set consumption VVb, which is one of the input variables of the closed-loop rail pressure control system 13. In accordance with the invention, the static set volume flow Vs(SL) is corrected by adding a dynamic set volume flow Vd(SL). The dynamic set volume flow Vd(SL) is computed by a dynamic correction unit 24. The input variables of the dynamic correction unit 24 are the set rail pressure pCR(SL), the actual rail pressure pCR(IST), and the dynamic rail pressure pCR(DYN). The dynamic correction unit 24 is shown in FIG. 4 and will be described in connection with FIG. 4. The sum of the static volume flow Vs(SL) and the dynamic set volume flow Vd(SL) is a corrected set volume flow Vk(SL), which is limited above to a maximum volume flow VMAX and below to a value of zero by a limiter 25. The maximum volume flow VMAX is computed by a (2D) characteristic curve 26 as a function of the actual rail pressure pCR(IST). The output variable of the limiter 25 is a resultant set volume flow Vres(SL), which is one of the input variables of a pressure control valve input-output map 27. The second input variable is the actual rail pressure pCR(IST). A set current iDV(SL) of the pressure control valve is assigned to the resultant set volume flow Vres(SL) and to the actual rail pressure pCR(IST) by the pressure control valve input-output map 27. A PWM computing unit 28 converts the set current iDV(SL) to the duty cycle PWMDV, with which the pressure control valve 12 is controlled. A current controller, closed-loop current control system 29, or a current controller with input control can be subordinate to the conversion. The current controller is shown in FIG. 5 and will be explained in the description of FIG. 5. The current controller with input control is shown in FIG. 6 and will be explained in the description of FIG. 6. The pressure control valve 12 is controlled with the PWM signal PWMDV. The electric current iDV that occurs at the pressure control valve 12 is converted for current control to an actual current iDV(IST) by a filter 30 and fed back to the computing unit 28 for the PWM signal. The output signal of the pressure control valve 12 is the rail pressure disturbance variable VDRV, i.e., the fuel volume flow that is redirected from the rail into the fuel tank.

FIG. 4 shows the dynamic correction unit 24 from FIG. 3.

The input variables are the set rail pressure pCR(SL), the actual rail pressure pCR(IST), the dynamic rail pressure pCR(DYN), a constant control deviation epKON, and a constant factor fKON. The output variable is the dynamic set volume flow Vd(SL). A limited control deviation epLIM is assigned to the set rail pressure pCR(SL) by a characteristic curve 31. The value of the limited control deviation epLIM is negative. For example, a limited control deviation epLIM=−100 bars is assigned to the set rail pressure pCR (SL)=2150 bars by the characteristic curve 31. A first switch S1 serves to determine whether its output variable AG1 corresponds to the limited control deviation epLIM or to the constant control deviation epKON. In the switch position S1=1, AG1 epLIM, while in switch position S1=2, AG1=epKON. The constant control deviation can be set, for example, to the value epKON=−50 bars. At a summation point A, the output variable AG1 is compared with the control deviation ep. The control deviation ep is computed at a summation point B from the set rail pressure pCR(SL) and the actual rail pressure pCR(IST) or, alternatively, the dynamic rail pressure pCR(DYN), The selection is made by a second switch S2. In the first switch position S2=1, the actual rail pressure pCR(IST) determines the computation of the control deviation ep. In the second switch. position S2=2, on the other hand, the dynamic rail pressure pCR (DYN) determines the computation of the control deviation. The difference computed at summation point A represents a resultant control deviation epRES.

A comparator 32 compares the resultant control deviation epRES with the value zero. If the resultant control deviation epRES is less than zero (epRES<0), then a third switch S3 is set to the position S3=2. In this case, the dynamic set volume flow Vd(SL) is equal to zero (Vd(SL)=0). On the other hand, if the resultant control deviation epRES is greater than or equal to zero (epRES≥0), then the third switch is set to the position S3=1.

In this position S3=1, the dynamic set volume flow Vd(SL) is computed by multiplying the resultant control deviation epRES by a factor f. The factor f in turn is determined by a fourth switch S4. If the fourth switch is in the position S4=1, then the factor f is computed as a value fKL by a characteristic curve 33 as a function of the actual rail pressure pCR(IST) (switch S2=1) or as a function of the dynamic rail pressure pCR(DYN) (switch S2=2), On the other hand, if the fourth switch is in the position S4=2, then the factor f is set to a constant value fKON, for example, fKON=0.01 liters/(min-bars).

The function of the dynamic correction unit 24 will now be explained by an example, which is based on the following parameters:

first switch S1=2 with epKON=−50 bars, second switch S2=1 with ep=pCR(SL)−pCR(IST), and fourth switch S4=2 with f=fKON=0.01 liters/(min·bars).

If the control deviation is greater than −50 bars (ep>(−50 bars)), then the resultant control deviation epRES is less than zero (epRES<0). The third switch is thus moved into the position S3=2 by the comparator 32, so that the dynamic set volume flow Vd(SL)=0. On the other hand, if the control deviation is less than or equal to −50 bars (ep≤(−50 bars)), then the resultant control deviation epRES>0. The comparator 32 thus moves the third switch into the position S3=1. The dynamic set volume flow is now computed as Vd(SL) =(−50 bars−ep)·0.01 liters/(min·bars).

A correction by means of the dynamic set volume flow Vd(SL) thus occurs when the control deviation ep falls below the value ep=−50 bars. If the control deviation ep becomes even smaller (more negative), i.e., if the actual rail pressure overshoots even more strongly, then the dynamic set volume flow Vd(SL) causes the fuel volume flow that is redirected by the pressure control valve, i.e., the rail pressure disturbance variable, to be increased. Finally, this causes the rail pressure to level off.

FIG. 5 shows a pure current controller, which corresponds to the closed-loop current control system 29 in FIG. 3. The input variables are the set current iDV(SL) for the pressure control valve, the actual current iDV(IST) of the pressure control valve, the battery voltage UBAT, and controller parameters (kp, Tn). The output variable is the PWM signal PWMDV, with which the pressure control valve is controlled. First, the current control deviation ei is computed from the set current iDV(SL) and the actual current iDV (IST) (see FIG. 3). The current control deviation ei is the input variable of the current controller 34. The current controller 34 can be realized as a PI or PI(DT1) algorithm. The controller parameters are processed in the algorithm. They are characterized, for example, by the proportional coefficient kp and the integral-action time Tn. The output variable of the current controller 34 is a set voltage UDV (SL) of the pressure control valve. This is divided by the battery voltage UBAT and then multiplied by 100. The result is the duty cycle of the pressure control valve in percent.

FIG. 6 shows a current controller with combined input control as an alternative to FIG. 5. The input variables are the set current iDV(SL), the actual current iDV(IST), the controller parameters (kp, Tn), the ohmic resistance RDV of the pressure control valve, and the battery voltage UBAT. The output variable is again the PWM signal PWMDV, with which the pressure control valve is controlled. First, the set current iDV(SL) is multiplied by the ohmic resistance RDV. The result is a pilot voltage UDV(VS). The set current iDV(SL) and the actual current iDV(IST) are used to compute the current control deviation ei. The current controller 34 then uses the current control deviation ei to compute the set voltage UDV(SL) of the pressure control valve as a correcting variable. Here again, the current controller 34 can be realized either as a PI controller or as a PI(DT1) controller. The set voltage UDV(SL) and the pilot voltage are then added, and the sum is divided by the battery voltage UBAT and then multiplied by 100.

FIG. 7 shows the set volume flow input-output map 22, with which the static set volume flow Vs(SL) for the pressure control valve is determined. The input variables are the engine speed nMOT and the set injection quantity QSL. Engine speed values of 0 to 2000 rpm are plotted in the horizontal direction, and set injection quantity values of 0 to 270 $mm^3$/stroke are plotted in the vertical direction. The values inside the input-output map then represent the assigned static set volume flow Vs(SL) in liters/minute. A portion of the fuel volume flow to be redirected is determined by the set volume flow input-output map 22. The set volume flow input-output map 22 is realized in such a form that in the normal operating range a static set volume flow of Vs(SL)=0 liters/minute is computed. The normal operating range is outlined by a double line in FIG. 7. The region outlined by a single line corresponds to the low-load range. In the low-load range, a positive value of the static set volume flow Vs(SL) is computed. For example, at nMOT=1000 rpm and QSL=30 $mm^3$/stroke, a static set volume flow of Vs(SL)=1.5 liters/minute is determined.

FIG. 8 is a time chart showing a load rejection from 100% to 0% load in an internal combustion engine which is being used to power an emergency power generating unit (60-Hz generator). FIG. 8 comprises four separate graphs 8A to 8D, which show the following as a function of time: the generator output P in kilowatts in FIG. 8A, the engine speed nMOT in FIG. 8B, the actual rail pressure pCR(IST) in FIG. 8C, and the dynamic set volume flow Vd(SL) in FIG. 8D. The broken line in FIG. 8C shows the behavior of the actual rail pressure pCR(IST) without dynamic correction. The time chart in FIG. 8 was based on the same parameters as in the example described above in connection with FIG. 4. It was also based on a constant set rail pressure of pCR(SL) =2200 bars.

At time t1 the load on the generator was suddenly reduced from an output of P=2000 kW to 0 kW. The absence of a load at the power take-off of the internal combustion engine causes an increasing engine speed at time t1. At time t4 the engine speed reaches its maximum value of nMOT=1950 rpm. Since the engine speed is automatically controlled in its own closed-loop control system, it settles back to its original initial value. Due to the increasing engine speed nMOT and the resulting reduction of the injection quantity starting at time t1, the high-pressure pump builds up a higher pressure level in the rail, so that the actual rail pressure pCR(IST) increases with a time lag relative to the engine speed nMOT. At time t2 the actual rail pressure pCR(IST) reaches the value pCR(IST)=2250 bars. The control deviation ep is thus ep=−50 bars. The dynamic set volume flow Vd(SL), which is computed by the dynamic correction unit 24 (FIG. 3), is therefore Vd(SL)=0 liters/min. Since the actual rail pressure pCR(IST) continues to rise after time t2, the control deviation ep drops, i.e., it falls below the value −50 bars, so that now a positive dynamic set volume flow Vd(SL) is computed (see FIG. 8D). At time t3 the actual rail pressure reaches the value pCR(IST)=2300 bars. This results in a control deviation of ep=−100 bars. The dynamic set volume flow computed from this is now Vd(SL)=0.5 liters/min. An increasing dynamic set volume flow Vd(SL) corresponds to an increasing actual rail pressure pCR(IST). A decreasing dynamic set volume flow Vd(SL) corresponds to a decreasing actual rail pressure pCR(IST). At time t7 the actual rail pressure pCR(IST) falls back below the value pCR(IST) =2250 bars, which results in a dynamic set volume flow of Vd(SL)=0 liters/min (see FIG. 8D).

Figure 8A:
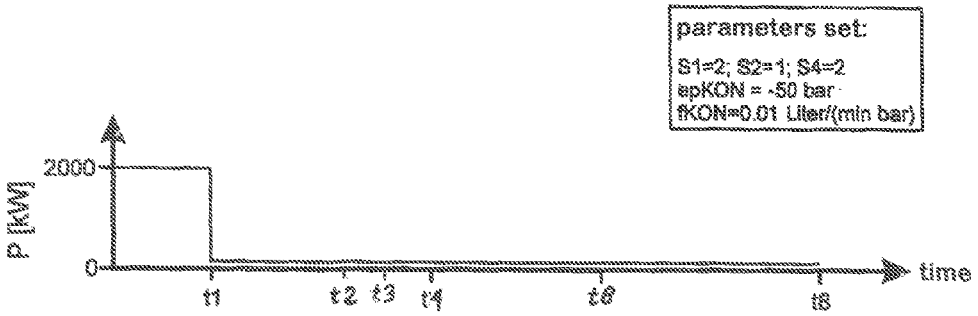
FIG. 8 is a time chart.
Figure 8B:
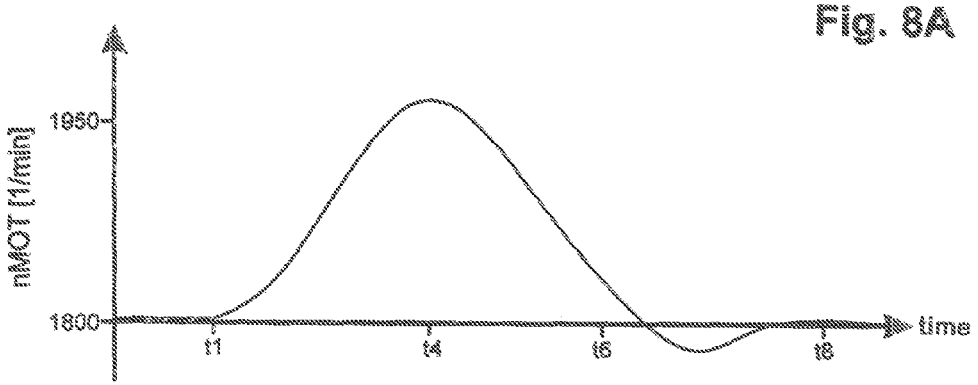
Figure 8C:
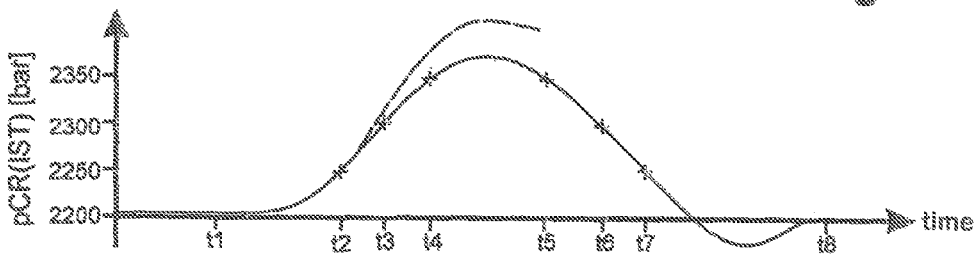
Figure 8D:
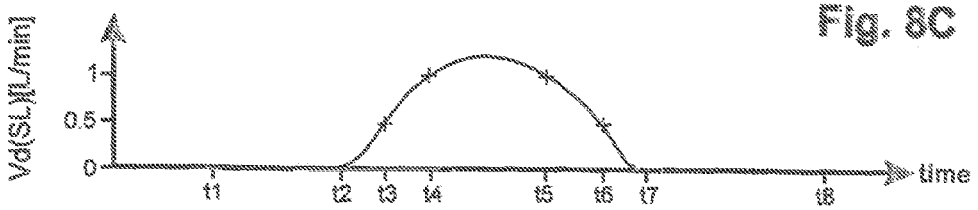

A comparison of the two curves of the actual rail pressure pCR(IST) in FIG. 8C with dynamic correction (solid-line curve) and without dynamic correction (broken-line curve) shows a reduction of the overshoot, which then also results in a shorter correction time.

Figure 9:
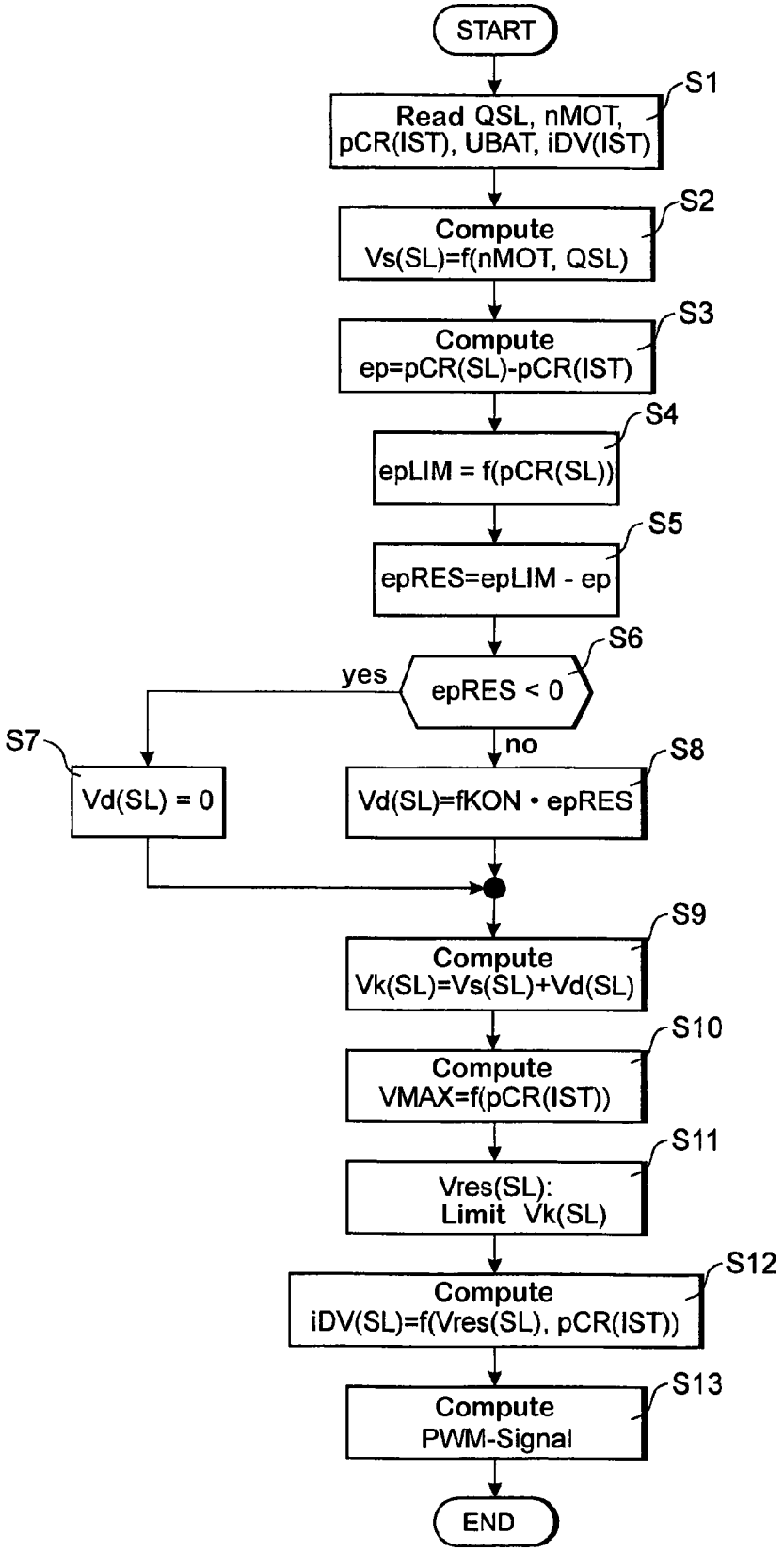
FIG. 9 is a program flowchart.

FIG. 9 is a program flowchart of the method for determining the rail pressure disturbance variable with correction. It was based on the following parameters:

the first switch S1=1, so that the computation of the limited control deviation epLIM is activated, the second switch S2=1, so that the control deviation is computed from the set rail pressure pCR(SL) and the actual rail pressure pCR(IST), and the fourth switch S4=2, so that the factor f is equal to fKON.

At S1 the set injection quantity QSL, the engine speed nMOT, the actual rail pressure pCR(IST), the battery voltage UBAT, and the actual current iDV(IST) of the pressure control valve are read in. At S2 the static set volume flow Vs(SL) is then computed by the set volume flow input-output map as a function of the set injection quantity QSL and the engine speed nMOT. At S3 the control deviation ep is computed from the set rail pressure pCR(SL) and the actual rail pressure pCR(IST). In step S4 the limited control deviation epLIM, which is negative, is computed from the set rail pressure by a characteristic curve 31 (FIG. 4). The resultant control deviation epRES is then computed at S5. The resultant control deviation epRES is determined from the control deviation ep and the limited control deviation epLIM. At S6 an interrogation is made to determine whether the resultant control deviation epRES is negative. If this is the case, then the dynamic set volume flow Vd(SL) is set to a value of zero at S7. If the resultant control deviation epRES is not negative, then at S8 the dynamic set volume flow Vd(SL) is computed as the product of the constant factor fKON and the resultant control deviation epRES. At S9 the corrected set volume flow Vk(SL) is computed as the sum of the static set volume flow Vs(SL) and the dynamic set volume flow Vd(SL). At S10 the maximum volume flow VMAX is computed from the actual rail pressure pCR(IST) by a characteristic curve 26 (FIG. 3). At S11 VMAX is then set as the upper limit to the corrected set volume flow Vk(SL). The result is the resultant set volume flow Vres(SL). At S12 the set current iDV(SL) is computed as a function of the resultant set volume flow Vres(SL) and the actual rail pressure pCR(IST). Finally, at S13 the PWM signal for controlling the pressure control valve is computed as a function of the set current iDV(SL). The program is then ended.

LIST OF REFERENCE NUMBERS

1 internal combustion engine
2 fuel tank
3 low-pressure pump
4 suction throttle
5 high-pressure pump
6 rail
7 injector
8 individual accumulator (optional)
9 rail pressure sensor
10 electronic control unit (ECU)
11 pressure control valve, passive
12 pressure control valve, electrically controllable
13 closed-loop rail pressure control system
14 pressure controller
15 limiter
16 pump characteristic curve
17 computing unit for PWM signal
18 controlled system
19 first filter
20 second filter
21 open-loop control unit
22 set volume flow input-output map
23 computing unit
24 dynamic correction unit
25 limiter
26 characteristic curve
27 pressure control valve input-output map
28 computing unit for PWM signal
29 closed-loop current control system (pressure control valve)
30 filter
31 characteristic curve
32 comparator
33 characteristic curve
34 current controller

The invention claimed is:

1. A method for open-loop and closed-loop control of an internal combustion engine, comprising the steps of: automatically controlling rail pressure (pCR) in a closed-loop rail pressure control system by a suction throttle on a low-pressure side as a first pressure regulator; controlling a pressure control valve on a high-pressure side as a second pressure regulator, by which fuel is redirected from the rail into a fuel tank, to generate a rail pressure disturbance variable (VDRV) for influencing the rail pressure (pCR); computing the rail disturbance variable (VDRV) based on a corrected set volume flow (Vk(SL)) of the pressure control valve; computing the corrected set volume flow (Vk(SL)) from a static set volume flow (Vs(SL)) and a dynamic set volume flow (Vd(SL)); computing the dynamic set volume flow (Vd(SL)) of the pressure control valve by a dynamic correction unit as a function of a set rail pressure (pCR(SL)) and an actual rail pressure (pCR(IST); and computing the dynamic set volume flow (Vd(SL)) by computing a resultant control deviation (epRES) of the rail pressure (pCR) and, if the resultant control deviation (epRES) is less than zero (epRES<0), then setting the dynamic set volume flow (Vd (SL)) to a value of zero or, if the resultant control deviation (epRES) is greater than or equal to zero (epRES≥0), then setting the dynamic set volume flow (Vd(SL)) to a value of a product of the resultant control deviation (epRES) and a factor, wherein a position of the pressure control valve is controlled based on the corrected set volume flow (Vk(SL)).

2. The method in accordance with claim 1, including computing the static set volume flow (Vs(SL)) of the pressure control valve as a function of a set injection quantity (QSL) and an engine speed (nMOT) by a set volume flow input-output map.

3. The method in accordance with claim 1, including computing the resultant control deviation (epRES) by computing a control deviation (ep) of the rail pressure (pCR) as a difference between the set rail pressure (pCR(SL)) and the actual rail pressure (pCR(IST)), by computing a limited control deviation (epLIM) from the set rail pressure (pCR (SL)) by a characteristic curve, and by computing a difference between the limited control deviation (epLIM) and the control deviation (ep).

4. The method in accordance with claim 1, including computing the factor by a characteristic curve as a function of the actual rail pressure (pCR(IST)).

5. The method in accordance with claim 1, including using a dynamic rail pressure (pCR(DYN)) in the computation as an alternative to the actual rail pressure (pCR (IST)), where the actual rail pressure (pCR(IST)) is computed from the rail pressure (pCR) by a first filter, and the dynamic rail pressure (pCR(DYN)) is computed from the rail pressure (pCR) by a second filter.

6. The method in accordance with claim 3, including setting the limited control deviation (epLIM) and/or the factor to a constant value (epKON, fKON).

7. The method in accordance with claim 1, including computing the rail pressure disturbance variable (VDRV) by a pressure control valve input-output map.

8. The method in accordance with claim 1, including computing the static set volume flow (Vs(SL)) of the pressure control valve as a function of a set torque (MSL) and an engine speed (nMOT) by a set volume flow input-output map.

* * * * *